United States Patent [19]

Ruehl

[11] Patent Number: 5,061,528

[45] Date of Patent: Oct. 29, 1991

[54] EXTERNAL MANUFACTURING METHOD AND FACILITY FOR COATING VEHICLE STRUCTURAL COMPONENTS

[75] Inventor: Phillip C. Ruehl, Elm Grove, Wis.

[73] Assignee: A.O. Smith Corporation, Milwaukee, Wis.

[21] Appl. No.: 469,253

[22] Filed: Jan. 24, 1990

Related U.S. Application Data

[63] Continuation-in-part of Ser. No. 389,346, Aug. 3, 1989.

[51] Int. Cl.[5] ..... B05D 1/18

[52] U.S. Cl. ..... 427/430.1; 427/346; 118/423; 118/426; 118/429

[58] Field of Search ..... 118/423, 425, 426, 429, 118/428, 500; 427/346, 430.1, 443

[56] References Cited

U.S. PATENT DOCUMENTS

| | | | |
|---|---|---|---|
| 2,073,576 | 3/1937 | Climenhaga | 118/423 X |
| 2,116,430 | 5/1938 | Gordon | 118/423 |
| 2,552,612 | 5/1951 | Adams et al. | 118/423 X |
| 2,570,746 | 10/1951 | Babuk | 118/423 X |
| 2,658,008 | 11/1953 | Williams et al. | 118/423 |
| 2,728,686 | 12/1955 | Borushko | 118/423 X |
| 2,852,410 | 9/1958 | Brewer | 118/500 X |
| 2,862,236 | 12/1958 | Shapero | 118/423 X |
| 2,944,655 | 7/1960 | Griswold | 198/409 |
| 3,183,818 | 5/1965 | Pangborn et al. | 118/423 X |
| 3,472,203 | 10/1969 | Coleman | 118/425 |
| 4,407,225 | 10/1983 | Kataishi et al. | 118/425 |
| 4,408,560 | 10/1983 | Caratsch | 118/425 X |
| 4,473,604 | 9/1984 | Rolle et al. | 118/423 |
| 4,502,410 | 3/1985 | Donahue | 118/429 |
| 4,560,592 | 12/1985 | Fredland | 118/425 X |
| 4,834,019 | 5/1989 | Gorden et al. | 118/423 |

FOREIGN PATENT DOCUMENTS

| | | | |
|---|---|---|---|
| 0018925 | 1/1985 | Japan | 118/423 |

*Primary Examiner*—Shrive Beck
*Assistant Examiner*—Alain Bashore
*Attorney, Agent, or Firm*—Andrus, Sceales, Starke & Sawall

[57] ABSTRACT

A manufacturing facility (200) has substantially reduced space requirements for applying a coating to vehicle structural components such as frames (202). A coating tank (204) has a housing (234) with a specially configured slot (238) allowing passage therethrough of a cable (218) of a winch pulley (216) which translates along a support beam (214) of a jib crane (208) having a central hub (210) rotational about a vertical axis (212). An arm (220) pivots about a horizontal pivot axis (232) at the hub (210) below the support beam (214) to lower and raise the frame (202) into and out of the horizontal coating tank (204).

5 Claims, 12 Drawing Sheets

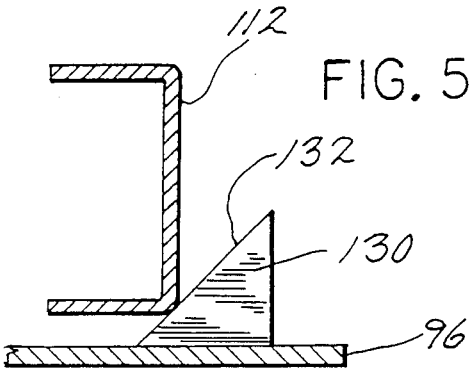
FIG. 5
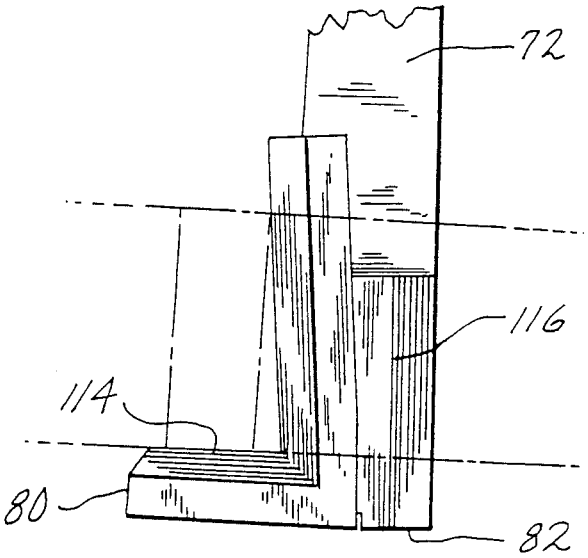
FIG. 6
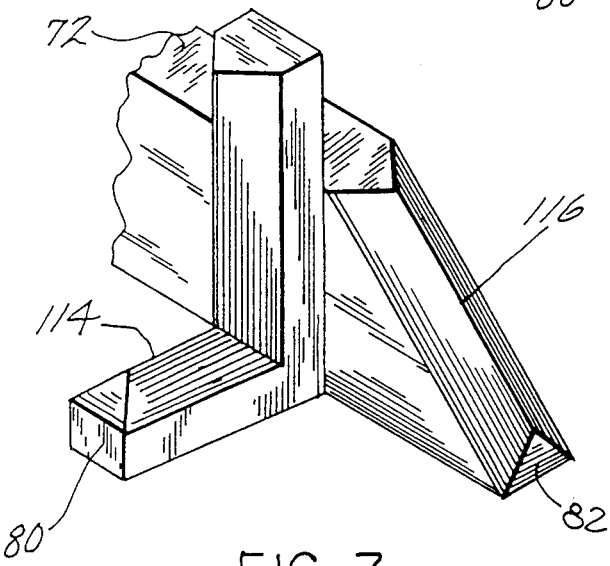
FIG. 7
FIG. 12
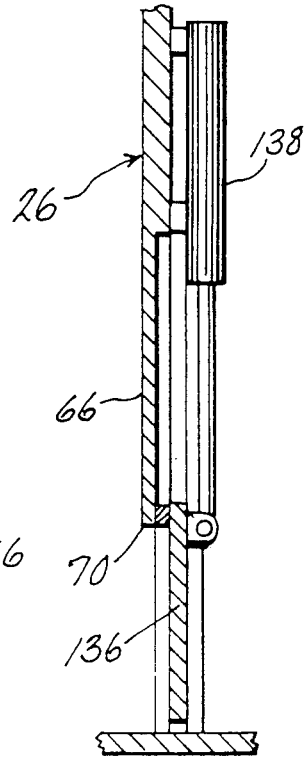
FIG. 11
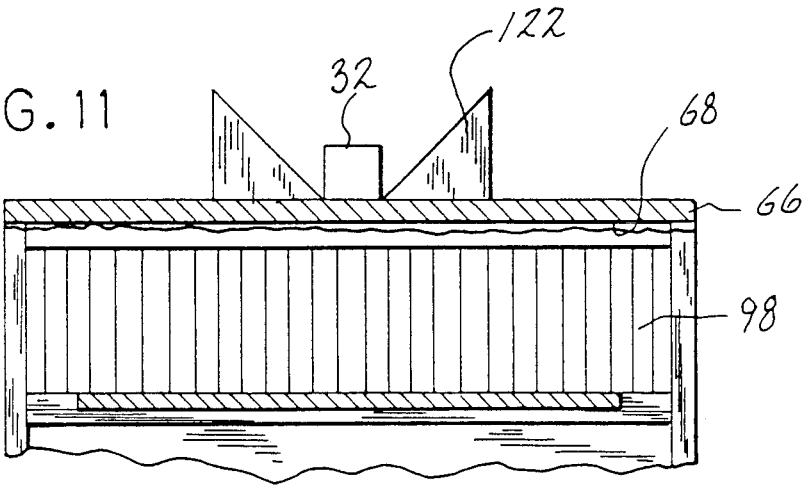

FIG. 8
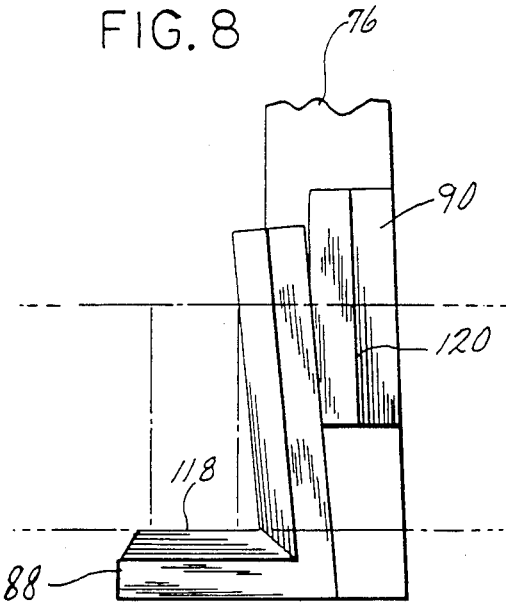
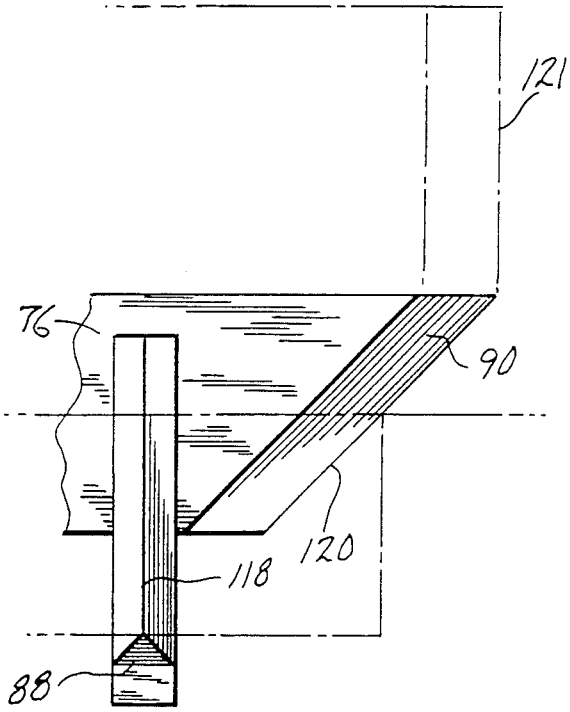
FIG. 9
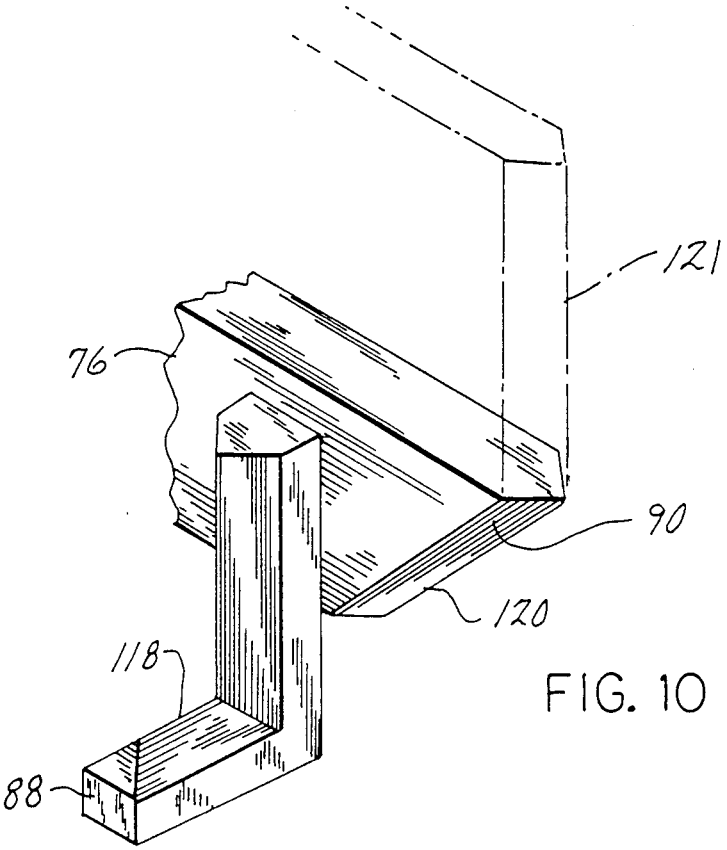
FIG. 10

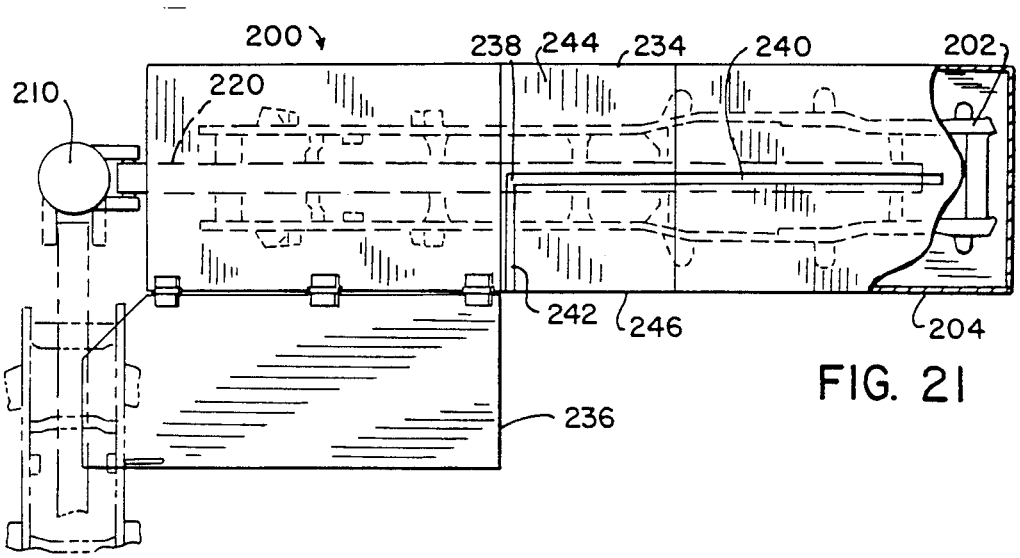
FIG. 21
FIG. 20
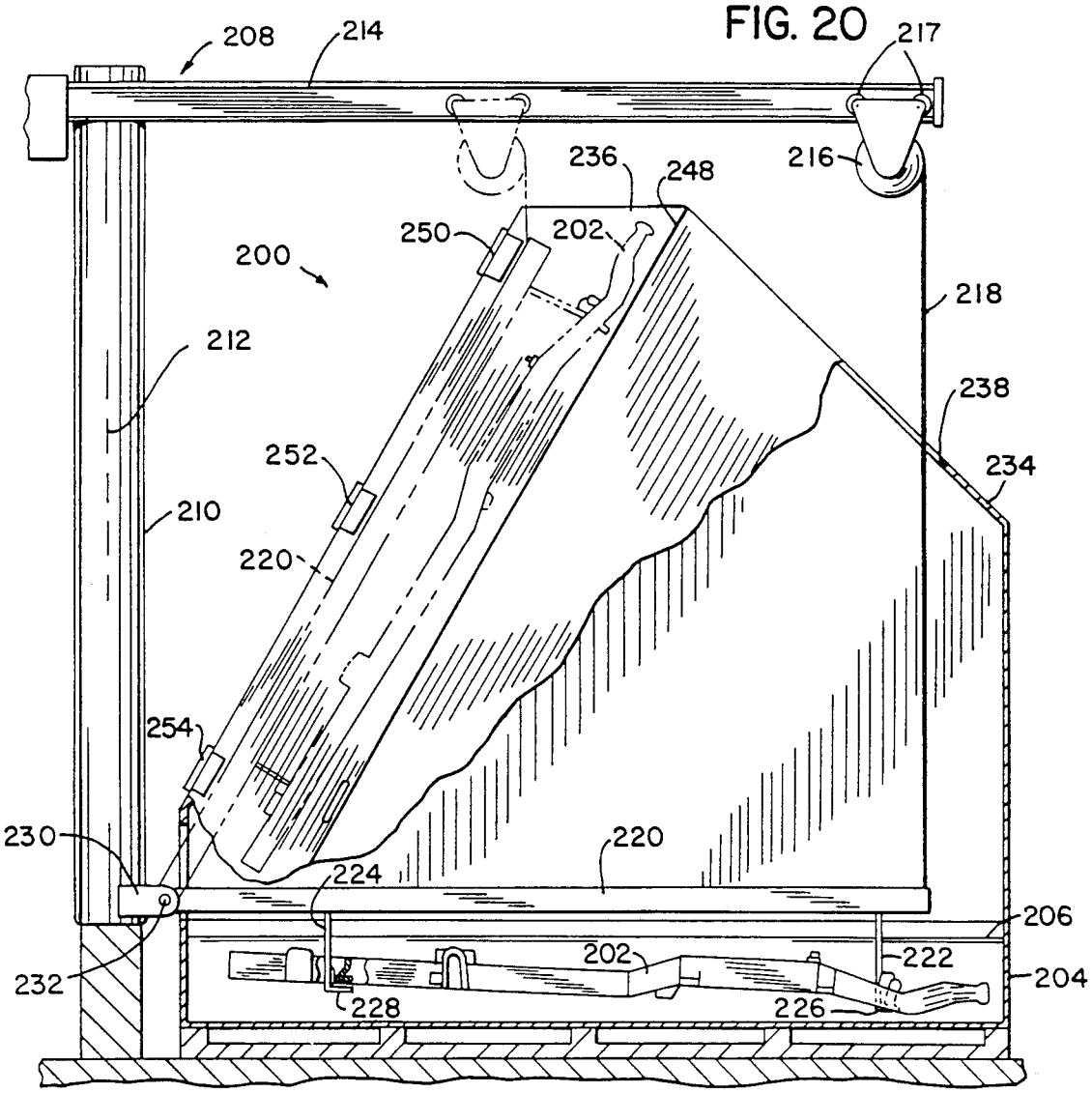

FIG. 24
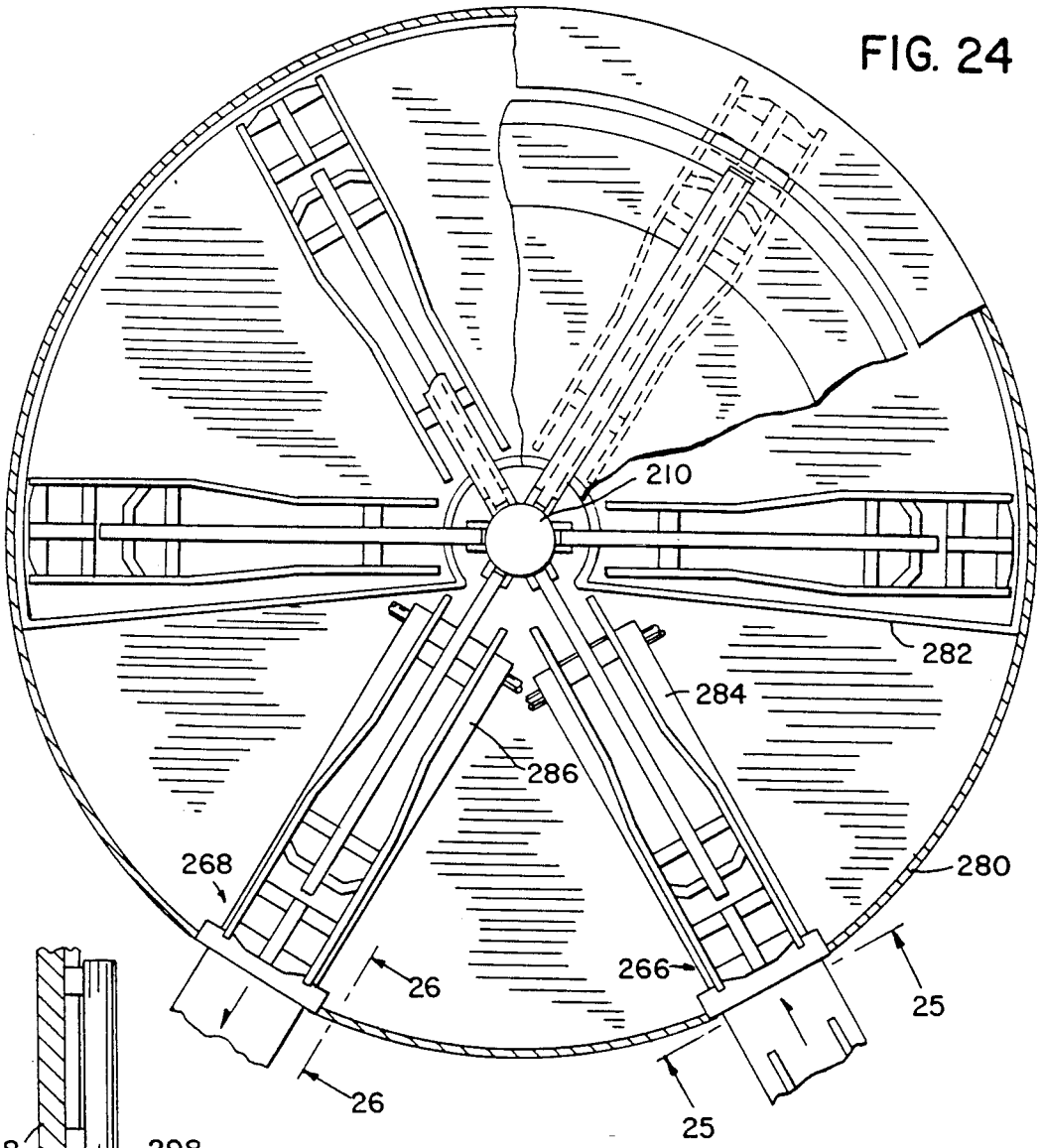
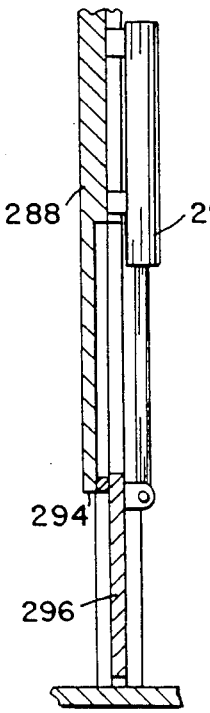
FIG. 26
FIG. 25
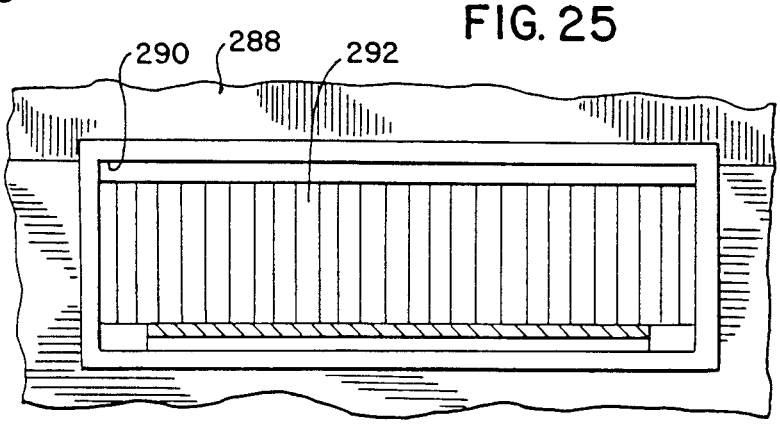

EXTERNAL MANUFACTURING METHOD AND FACILITY FOR COATING VEHICLE STRUCTURAL COMPONENTS

CROSS REFERENCE TO RELATED APPLICATION

This application is a continuation-in-part of application Ser. No. 07/389,346, filed Aug. 3, 1989.

BACKGROUND AND SUMMARY

The present invention relates to continuing development efforts directed toward manufacturing methods and facilities for applying a coating to vehicle structural components, including the application of a hot melt wax coating to vehicle frames for protection against rust and corrosion.

The invention of the noted parent application arose during development efforts directed toward reducing the high capital expense of a manufacturing facility for coating vehicle structural components such as frames. Vehicle manufacturers are more commonly requiring vendors and parts suppliers to have local on-site manufacturing or processing facilities coordinating with the assembly operation of the vehicle manufacturer. In the case of suppliers providing vehicle structural components such as frames, this requires erection of a coating facility at each of the various satellite assembly facilities. However, erection of multiple satellite coating facilities is not cost effective due to the extremely high capital expense of same.

A vehicle frame is a generally flat longitudinal structural member which in one exemplary size has a longitudinal length of about 178 inches, a lateral width of about 42 inches, and a height of about 16 inches, though the dimensions may of course vary. Prior facilities for applying a hot melt wax coating to such frames typically require buildings of about 2 million cubic feet, with 50,000 square feet of lateral area and over 60 feet in height. The frames are hung vertically and transported to a dipping tank and dipped downwardly into the tank for coating the frame in the hot melt wax liquid, and then raised out of the tank. Hence, the building must be at least twice as high as the longitudinal length of the frame. The tank volume is about 63,000 gallons. The building is heated by ovens or the like such that the heated air in the building preheats the frames prior to dipping, to enhance the coating during the dip into the hot melt wax liquid tank. Preheating of the frames with air is inefficient and requires long preheat times. The vertical hanging of the frames also requires large openings into and out of the building, causing significant heat loss and energy inefficiency. The construction cost of the building is high because of its special requirements. Furthermore, the building has no other use.

The invention of the parent application addresses and solves the above noted problems with a simple and effective manufacturing method and facility. The invention of the parent application reduces the building volume by a factor of 10 or more, e.g. the new building can be reduced to as little as 5% of the volume of the prior building. The invention of the parent application also reduces the tank volume requirements for the coating liquid to as little as 4%, e.g. to as low as 2,000 gallons instead of the 63,000 gallons required for the above noted prior tank. This saves wax cost. The invention of the parent application also significantly reduces the height requirement of the tank, e.g. from about 25 feet deep to about 25 inches deep. This desirably solves problems of hydrostatic fluid pressure and leakage caused thereby at the bottom of the tank. The construction cost of the building is reduced by a factor of about 10 due to the reduced special requirements of the building and also due to reduced loading capability of the building due to special transport structure within the building in accordance with the invention for carrying the vehicle structural components. The building is adaptable to other uses in the event of changing requirements. The transport mechanism and core within the building can be moved to other buildings and locations.

The present invention provides a manufacturing method and facility with substantially reduced space requirements. The invention enables substantial portions of the processing mechanism to be placed external to the heated housing containing the coating tank. The invention is also suitable to low volume, small quantity applications, if desired. In one embodiment, a tank housing has a specially configured slot opening allowing passage therethrough of a cable of a winch pulley which rolls along a support beam of a jib crane as an arm pivots to lower and raise the frame into and out of a horizontal tank. The tank is 24 feet long by 6 feet wide by 32 inches deep to provide a volume of 384 cubic feet and holds 2,872 gallons, and has a surface area of 144 square feet. The volume of the shell housing over the tank is 2,262 cubic feet. In another embodiment, the tank extends partially circumferentially around a central rotational hub and has an area of 536 square feet and a volume of 984 cubic feet and holds 7,358 gallons. The volume of the shell housing over the tank is 5,074 cubic feet.

BRIEF DESCRIPTION OF THE DRAWINGS

Parent Application

FIG. 5 is a sectional view taken along line 5—5 of FIG. 4.

FIG. 6 is an enlarged view of a portion of the structure in FIG. 4.

FIG. 7 is a perspective view of the structure of FIG. 6.

FIG. 8 is an enlarged view of a portion of the structure in FIG. 4.

FIG. 9 is an end view of the structure in FIG. 8.

FIG. 10 is a perspective view of the structure in FIG. 8.

FIG. 11 is a sectional view taken along line 11—11 of FIG. 4.

FIG. 12 is a sectional view taken along line 12—12 of FIG. 1.

Present Invention

FIG. 20 is a side view of a manufacturing facility constructed in accordance with the present invention.

FIG. 21 is a top view of a portion of the structure in FIG. 20.

Figure 22:
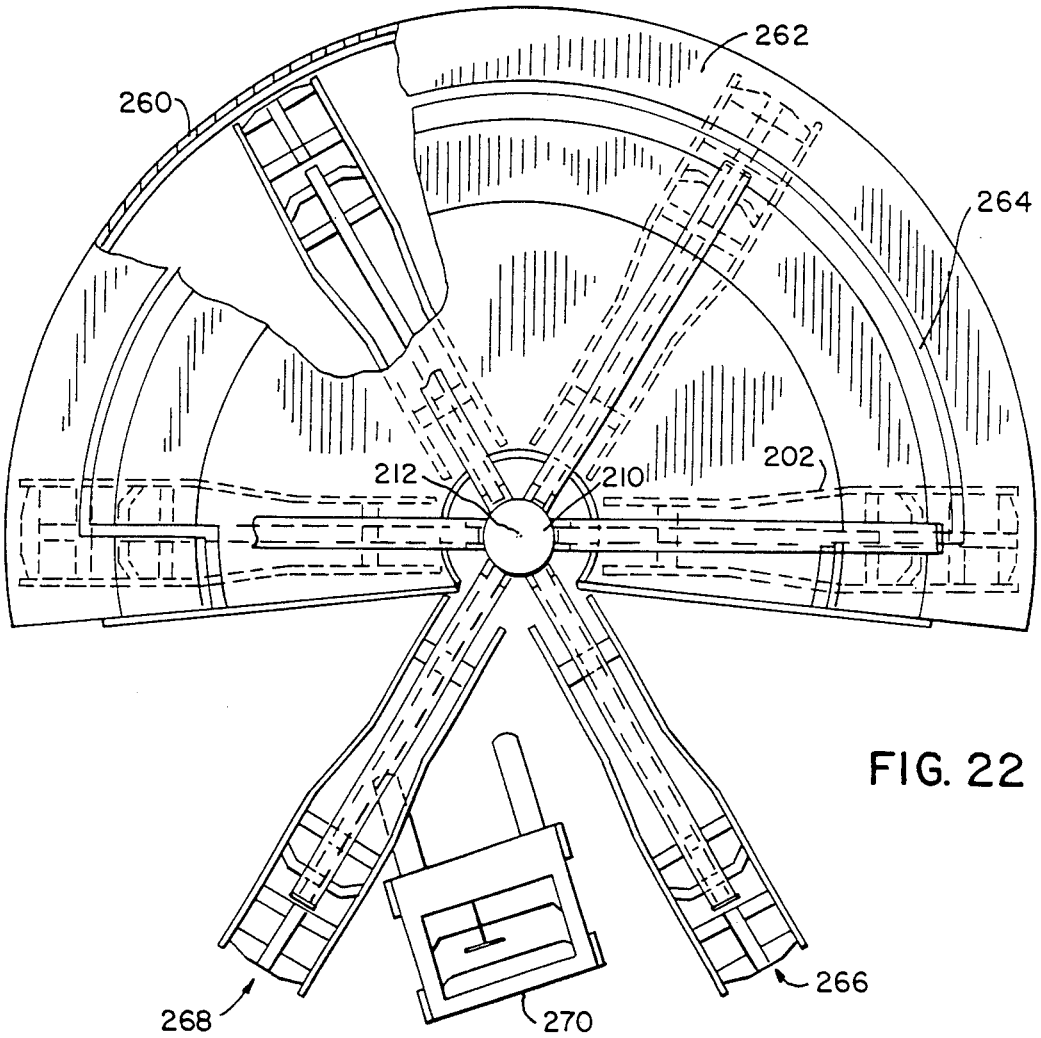

FIG. 22 is a top view of an alternate embodiment of a manufacturing facility constructed in accordance with the invention.

Figure 23:
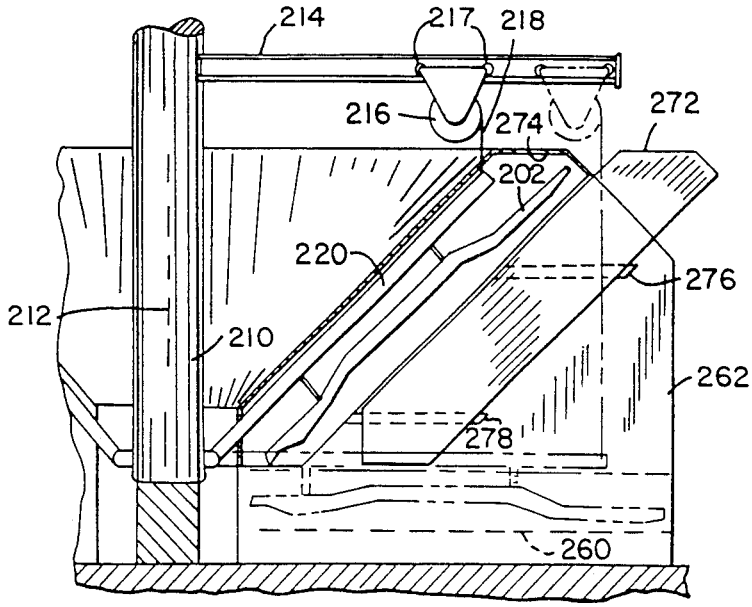

FIG. 23 is a side view of a portion of the structure of FIG. 22.

FIG. 24 is a top view of another embodiment of a manufacturing facility constructed in accordance with the invention.

FIG. 25 is a view taken along line 25—25 of FIG. 24.

FIG. 26 is a view taken along line 26—26 of FIG. 24.

DETAILED DESCRIPTION

Parent Application

Figure 1:
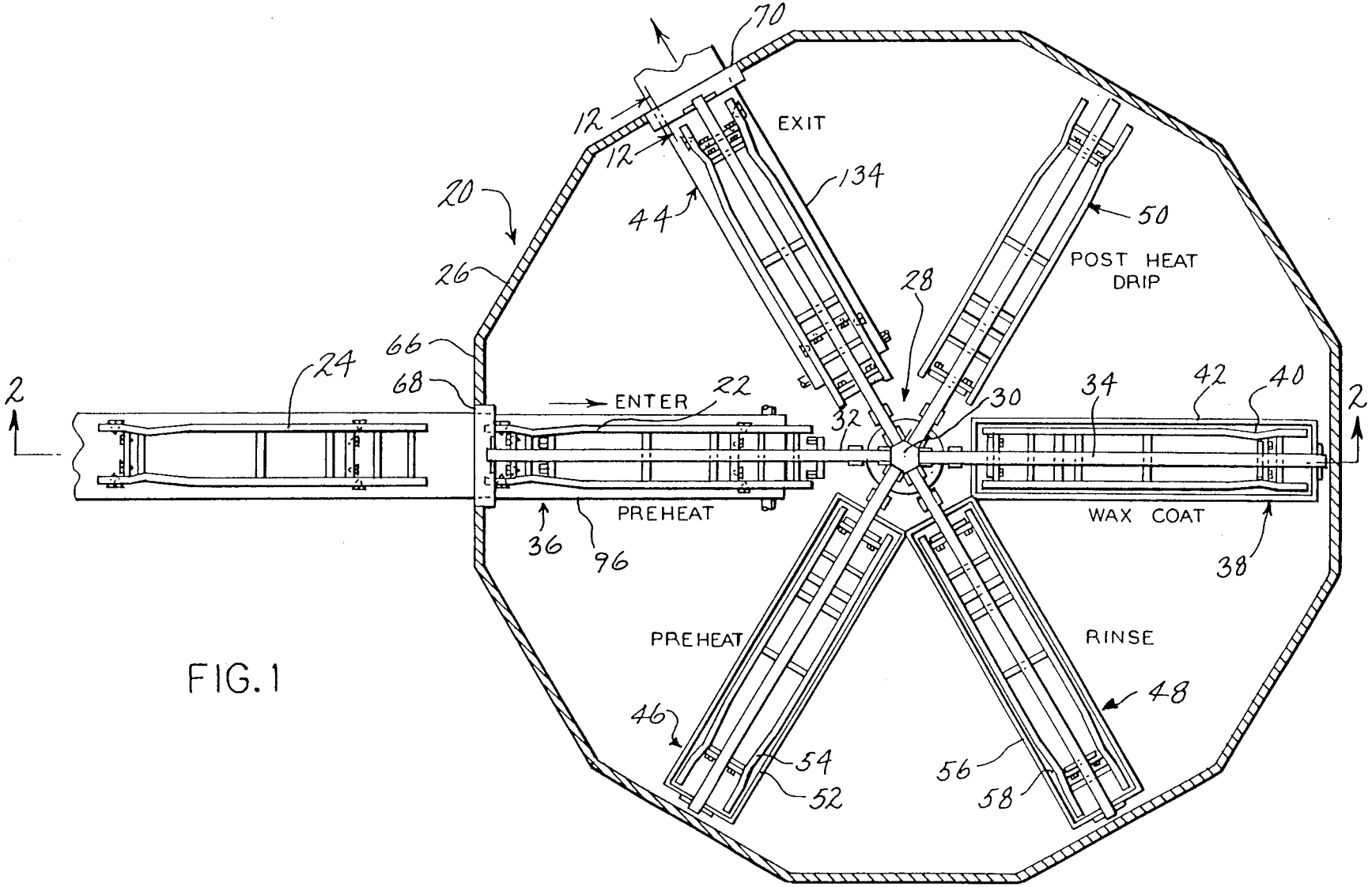
FIG. 1 is a top view of a manufacturing facility constructed in accordance with the invention of the parent application.

FIG. 1 shows a manufacturing facility 20 with substantially reduced space requirements for applying a coating to vehicle structural components such as frames 22, 24, and the like. The facility includes a building housing a central rotary carousel 28 having a central hub 30 rotatable about a vertical axis and having a plurality of arms 32, 34, etc. thereon. Building 26 also houses a loading station 36, a coating station 38 having coating liquid 40 in tank 42, and an unloading station 44, all spaced peripherally around hub 30 such that rotation of hub 30 moves the arms to the various stations. Building 26 also houses a preheat wash station 46, a rinse station 48, and a post heat drip station 50. Preheat wash station 46 includes a tank 52 with a wash liquid 54 at an elevated temperature. Rinse station 48 includes a tank 56 with a rinse liquid 58 at an elevated temperature. The preheat wash and rinse stations preheat the frame by liquid heat transfer, to enhance the hot melt wax coating at station 38 when the frame is dipped into the hot melt wax coating liquid 40, to be described.

Counterclockwise rotation of hub 30 moves arm 32 to loading station 36 as shown in FIG. 1, for attaching frame 22 to arm 32, to be described. Further counterclockwise rotation of hub 30 moves arm 32 to preheat wash station 46, and then to rinse station 48, and then to coating station 38, and then to post heat drip station 50, and then to unloading station 44 for detaching frame 44 from the arm.

Figure 2:
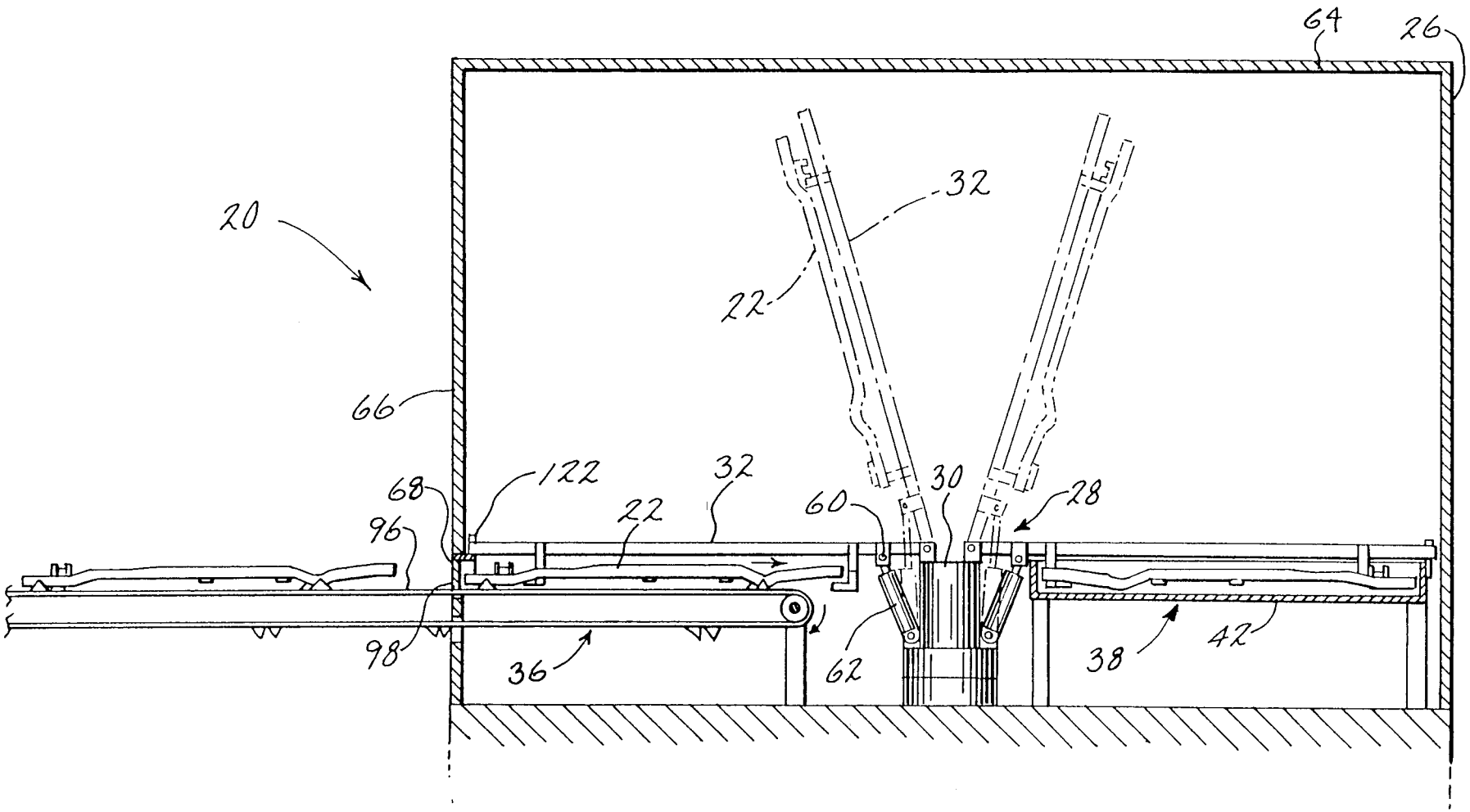
FIG. 2 is a sectional view taken along line 2—2 of FIG. 1.

Arm 32 moves downwardly, FIG. 2, at loading station 36 to engage frame 22 and then moves upwardly to lift the frame and carry the frame during rotation of hub 30. The arm moves downwardly at each of stations 46, 48 and 38 to lower the frame into the liquid in the respective tank, and then moves upwardly to raise the frame out of such liquid in the respective tank. The arm moves downwardly at unloading station 44 to disengage the frame and then moves upwardly and rotates to loading station 36, to begin the next cycle.

Arm 32 swings in an arc about pivot point 60 at hub 30, and is actuated between its upwardly raised position as shown in phantom line and its downwardly lowered position as shown in solid line by a hydraulic cylinder 62, or alternatively is pneumatically actuated, or is raised and lowered by a cable, chain, or the like. Frame 22 at loading station 36 is attached in a generally horizontal position to arm 32. The frame is likewise detached in a generally horizontal position from the arm at unloading station 44. The frame is lowered by the arm into the respective tanks at stations 46, 48 and 38 in a generally horizontal position in the respective tank. The horizontal loading, dipped and unloading positions of the frame are all substantially coplanar.

Frame 22 has a longitudinal extent of a given length. As seen in FIG. 2, building 26 has a height to roof 64 substantially less than twice the length of frame 22. The transport mechanism provided by carousel 28 moves frame 22 through stations 36, 46, 48, 38 and 44 such that the longitudinal extent of frame 22 is substantially horizontal. The raising and lowering of frame 22 into and out of the tanks at stations 46, 48 and 38 defines a travel path having a vertical height substantially less than twice the length of the frame. Building 26 has a sidewall 66 with an entrance opening 68 therethrough, FIGS. 1, 2 and 11, at loading station 36, and an exit opening 70 therethrough at unloading station 44. Frame 22 is passed longitudinally through such openings in a generally horizontal position into and out of building 26, such that openings 68 and 70 have minimum dimensions, to minimize heat loss from the building.

At drip station 50, uncoated excess liquid is allowed to drip from the frame. Additionally or alternatively, uncoated excess liquid is allowed to drip from the frame above tank 42 at coating station 38. The amount of pivoting of the transport arm varies the tilt angle, to provide an adjustable drip angle of the frame. This is particularly desirable because it enables a selectively chosen drip angle, which in some instances may be vertical, or in other instances at a diagonal angle relative to horizontal. The latter is preferred to prevent drips from one of the lateral cross pieces of the frame from dripping onto another lateral cross piece therebelow. The pivoted transport arm thus moves the frame through the coating station into and out of contact with the coating liquid and raises the frame after such coating to a tilted position such that the longitudinal extent of the frame is tilted at an angle relative to horizontal.

Figure 3:
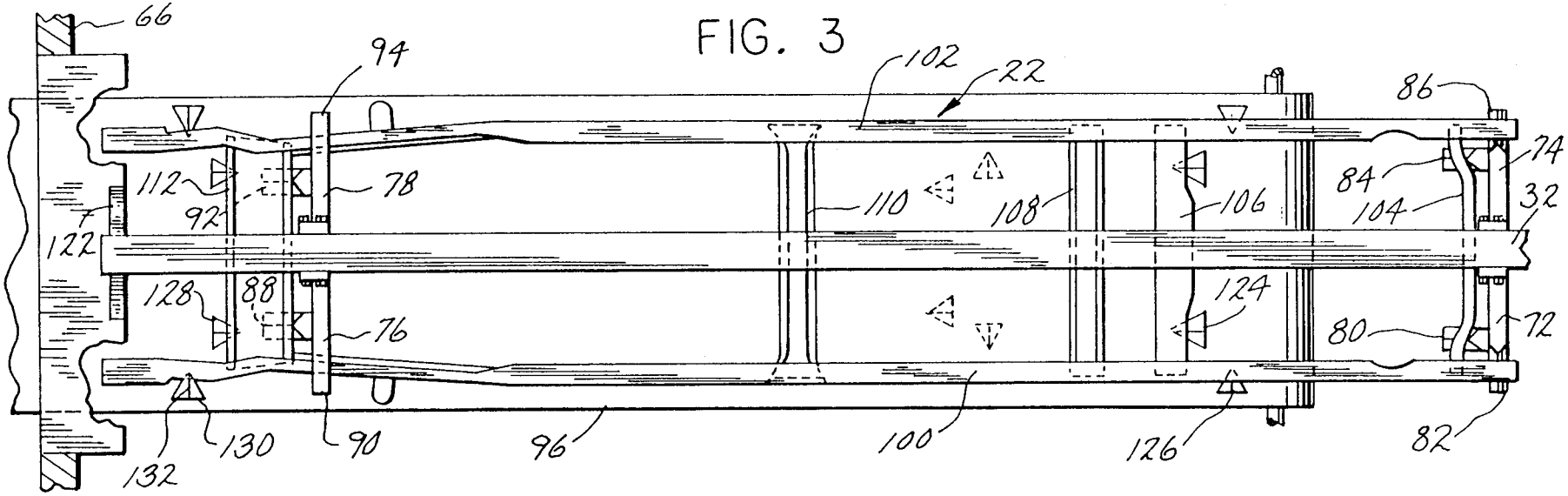
FIG. 3 is an enlarged top view of a portion of the structure in FIG. 1.
Figure 4:
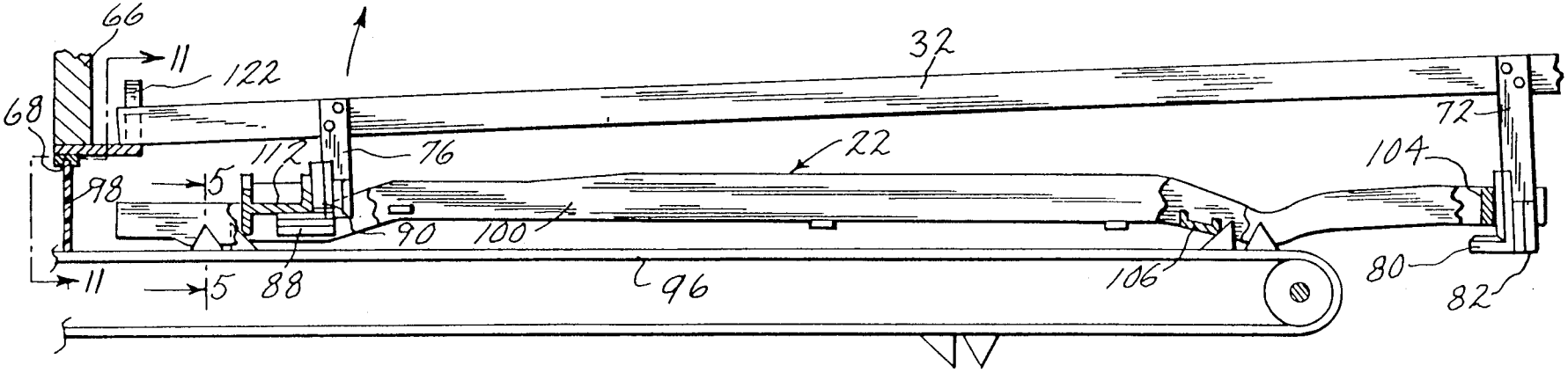
FIG. 4 is a side view of the structure in FIG. 3.

Hands 72, 74, 76, 78, FIGS. 3 and 4, extend from arm 32 and have fingers 80, 82, 84, 86, 88, 90, 92, 94 engaging frame 22. Frame 22 is attached to the fingers at loading station 36. A conveyance mechanism provided by continuous belt conveyor 96 carries frame 22 longitudinally horizontally through flexible hanging leaves 98 at opening 68 in building wall 66 to loading station 36. Conveyor 96 carries frame 22 rightwardly, FIGS. 1-4, to a first position. Arm 32 is swung downwardly, with at least some of the noted fingers moving downwardly past and below frame 22. Conveyor 96 then carries frame 22 further rightwardly, advancing frame 22 to a second position above the last mentioned fingers, such that upon swinging arm 32 upwardly, such last mentioned fingers engage the underside of frame 22 and lift same.

Frame 22 is a generally flat planar member having a pair of longitudinal sides 100 and 102, FIG. 3, and a plurality of lateral cross pieces such as 104, 106, 108, 110, 112. Fingers 80 and 84 engage the underside of cross piece 104. Fingers 82 and 86 engage the underside of longitudinal sides 100 and 102, respectively. Fingers 88 and 92 engage the underside of cross piece 112. Fingers 90 and 94 engage the top side of longitudinal sides 100 and 102, respectively. The noted engagement locates the longitudinal sides of the frame and the respective cross pieces of the frame, to precisely locate the frame both longitudinally and laterally.

The fingers are formed with a knife edge laterally crossing the respective portion of the frame, for example as shown at knife edges 114 and 116 for respective fingers 80 and 82 in FIGS. 6 and 7, and knife edges 118 and 120 for respective fingers 88 and 90 in FIGS. 8-10. The lower fingers 80, 84, 88, 92 are slightly angled, such that when arm 32 is in the lowered position, the lower fingers tilt upwardly leftwardly and engage only an edge of the frame to provide only point contact therewith, to enhance the coating of the frame. The lateral lower fingers 82 and 86 and the lateral upper fingers 90 and 94 extend laterally across the longitudinal sides of the frame and are likewise angled, as shown in FIGS. 7 for finger 82, and in FIGS. 9 and 10 for finger 90, to also provide only point contact with the frame, to enhance coating of the frame. The noted lower longitudinal fingers are tilted sufficiently relative to the respective hands such that arm 32 may be lowered to a position slightly beyond horizontal, FIG. 4, and the lower fingers will still engage and lift frame 22. In a further embodiment, finger 90 has an upwardly extending portion 121 facilitating stacking of frames. In this latter embodiment, two or more frames are carried on carousel arm 32, such that two or more frames are dipped during each dipping step, etc. In this embodiment, edge 120 does not engage the top of the frame therebelow, but rather locates the siderails of the frame outboard thereof, and edge 121 is spaced slightly inwardly of the frame siderail.

Stationary V-shaped structure 122, FIG. 11, is provided at loading station 36 and spaced above conveyor 96 and is engaged by arm 32 during downward swinging of the arm to guide and locate the arm relative to conveyor 96 and frame 22. Conveyor 96 has a plurality of cones 124, 126, 128, 130, etc., thereon, with angled bevel surfaces forming knife edges such as 132, FIGS. 3 and 5, which extend along a diagonal angle to provide point contact with the frame. Some of the cones such as cones 126 and 130 engage the longitudinal sides of the frame, and others of the cones such as cones 124 and 128 engage lateral cross pieces of the frame. The cones space the frame above conveyor 96 and precisely locate the frame both longitudinally and laterally. In an alternate embodiment, the frame has a plurality of holes in the underside thereof, and conveyor 96 has a plurality of cones extending upwardly partially through such holes and spacing the frame above the conveyor and precisely locating the frame both longitudinally and laterally.

Unloading at station 44 is comparable but reversed in sequence from loading at station 36. A conveyor 134 is provided like conveyor 96. The transport arm of the carousel is lowered to lower the frame onto the cones on the conveyor. The above noted knife edges and angles on the fingers provide the noted point contact with the frame and minimize marring of the coating on the frame. In most applications, there is no marring because the hot melt wax coating heals itself, which healing is facilitated by the noted point contact, which minimizes the area which must be healed by continued flow of the hot melt wax coating after disengagement of the frame by the fingers. The above noted beveled surfaces and knife edges such as 132, FIG. 5, of the cones on the conveyor and the angles thereof desirably provide only point contact with the coated frame on exit conveyor 134. After the pivot arm of the carousel is lowered such that the frame now rests on the cones on conveyor 134, the latter moves slightly to partially advance the frame to allow clearance of the lower fingers, and the pivot arm is then raised upwardly, whereafter conveyor 134 carries the frame outwardly through opening 70 of the building. Opening 70 is not provided with the hanging flexible leaves such as 98 of entrance opening 68, because such leaves would drag across and mar the coating on the frame. Instead, opening 70 is provided with a quick acting guillotine door 136, FIG. 12, actuated by pneumatic cylinder 138 to quickly move vertically upwardly and downwardly. This minimizes heat loss from the building.

Figure 13:
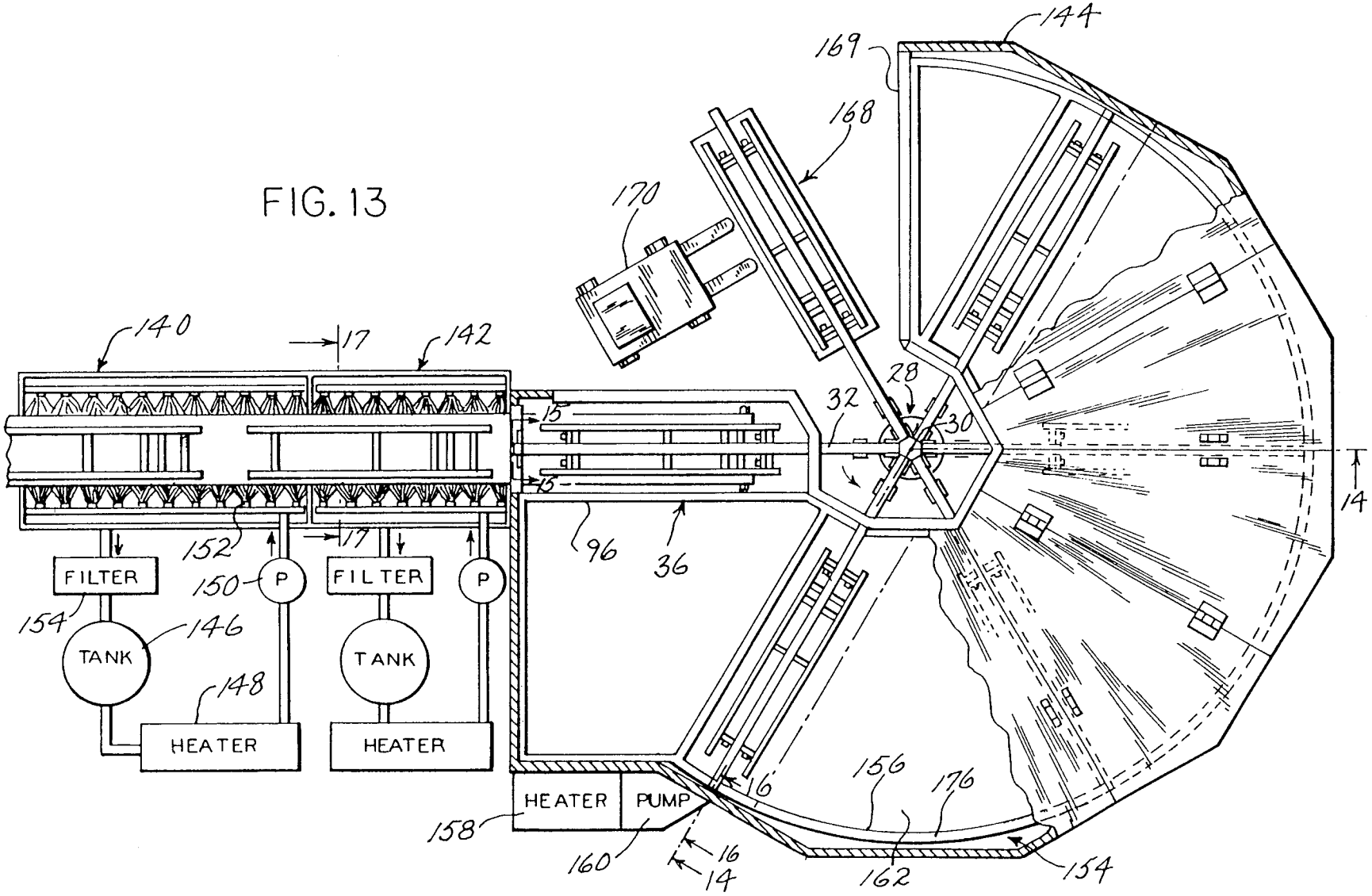
FIG. 13 is a top view of an alternate embodiment of a manufacturing facility constructed in accordance with the invention of the parent application.
Figure 16:
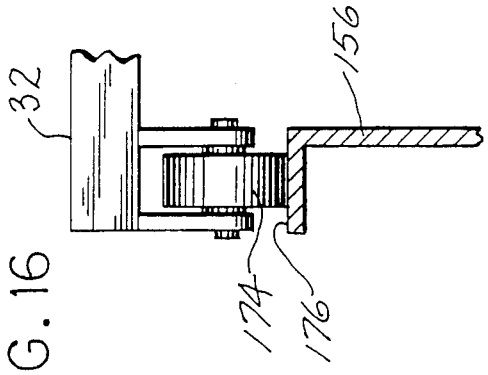
FIG. 16 is a sectional view taken along line 16—16 of FIG. 13.

FIG. 13 shows a further embodiment, and like reference numerals are used from the above FIGS. where appropriate to facilitate clarity. Preheat wash and rinse stations 140 and 142 are external of building 144. Preheat wash station 140 includes a tank 146, a heater 148, a pump 150 supplying heated wash liquid to spray nozzles 152, and a return filter 154. Rinse station 142 is comparable for rinse liquid. Conveyor 96 conveys the frame horizontally longitudinally through stations 140 and 142 to provide liquid heat transfer to the frame, and then moves the frame into building 144. This movement is along the direction of the longitudinal extent of the frame. The frame is attached to pivot arm 32 as above described, and the arm swings upwardly to lift the frame from conveyor 96.

Coating station 38 of FIG. 1 is replaced by a coating station 154 in FIG. 13 with a tank 156 which is substantially laterally expanded to extend along a significant portion of the inner periphery of the building around hub 30. In FIG. 13, tank 156 has a semicircular shape when viewed from above. Transport arm 32 lowers the frame into and out of tank 156, as above. Transport arm 32 also moves the frame horizontally through tank 156 in a direction transverse to the longitudinal extent of the frame. The lowering and raising of the frame into and out of the tank defines a travel path having a vertical height substantially less than twice the length of the frame, as before. A heater 158 and pump 160 are provided for heating and pumping coating liquid 162 to tank 156.

Figure 14:
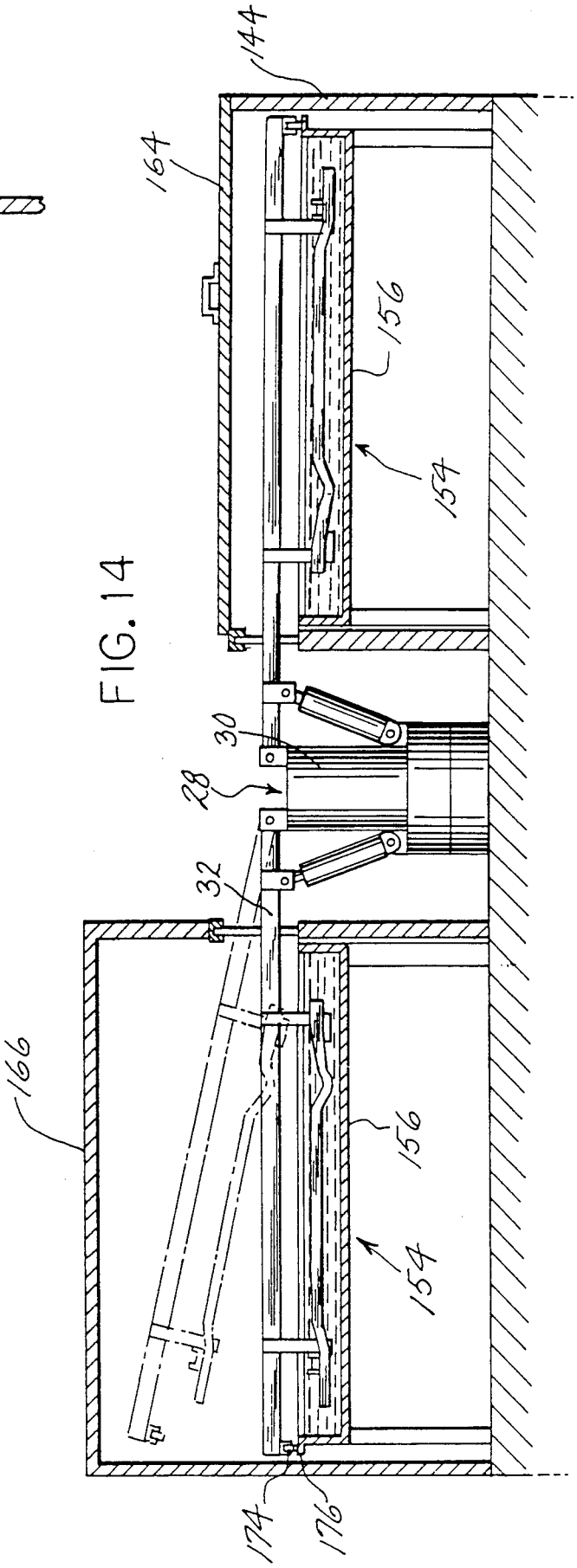
FIG. 14 is a sectional view taken along line 14—14 of FIG. 13.

Building 144 has differing heights at loading station 36 and the central portion of coating station 154. At loading station 136, the building must be high enough to allow arm 32 to pivot upwardly to lift the frame from conveyor 96. However, in the central portion of coating station 154, as shown on the right side of FIG. 14, arm 32 need only move horizontally laterally, and hence there is no need for any greater building height other than a small clearance for arm 32 above the tank. The roof of building 144 along this central portion of coating station 154 is provided by access doors 164. At the beginning of coating station 154, an increased building height is necessary as shown at roof 166 at the left side of FIG. 14, to accommodate movement of arm 32 in an upward position over tank 156 and then downward movement of arm 32 to lower the frame into tank 156. The building likewise has a higher roof at the end of coating section 154. The building thus has a first lower height at roof access door 164 over the middle of tank 156, and second higher heights as at roof 166 at the ends of the tank to permit downward and upward swinging of arm 32 to lower and raise the frame into and out of the tank. The unloading station may be provided within the building, as in FIG. 1, or an external loading station 168 may be provided with the frames remaining in a horizontal position but stacked vertically, and then periodically removed by a forklift 170 or the like. Building 144 has an external recess 169 formed in the periphery thereof at which unloading station 168 is located.

Figure 15:
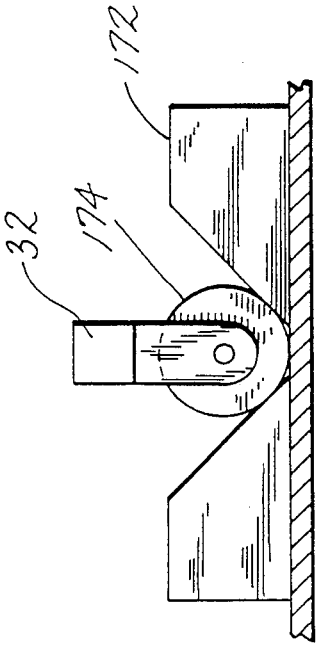
FIG. 15 is a sectional view taken along line 15—15 of FIG. 13.

In a further embodiment, a cam track is provided in the building to assist or eliminate the pivot arm actuators such as 62. FIG. 15 shows a cam track 172 extending at least partially peripherally around central hub 30. Arm 32 has a roller 174 engaging and rolling along the cam track during rotation of hub 30 such that arm 32 is lowered and raised according to the camming profile of the cam track. The cam track has a V-shape at loading station 136 such that roller 174 rides down the V to lower the arm to engage the frame. At coating station 154, the cam track may be provided by the upper lip 176 of the tank having high lobes at the beginning and the end of the tank, and having an extended low lobe along the central portion of the tank. The horizontal circumferential length of the low lobe portion of the cam surface controls the length of horizontal travel of the frame in coating liquid 162 in tank 156 during rotation of hub 30, to control coating of the frame.

Figure 18:
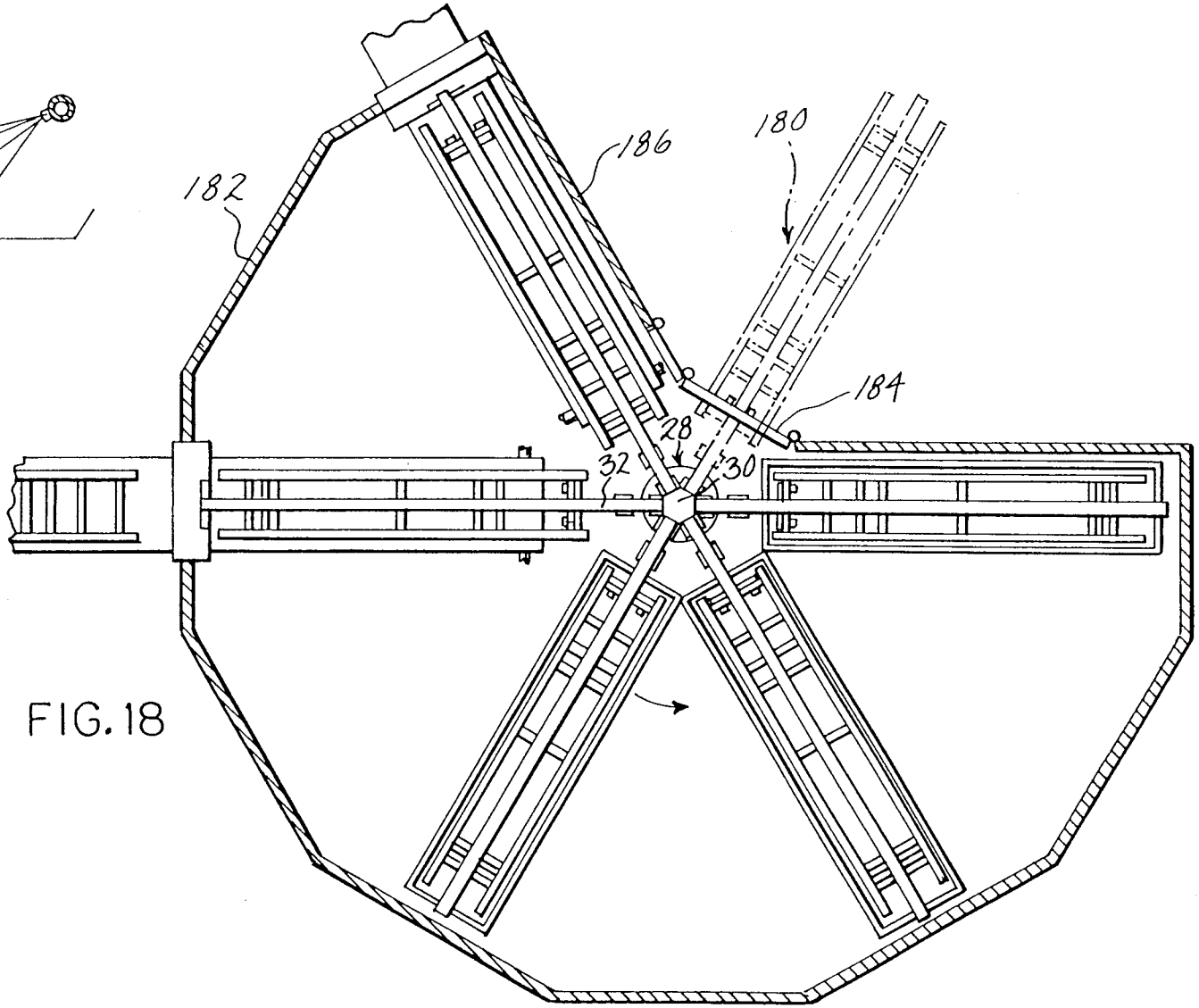
FIG. 18 is a top view of another embodiment of a manufacturing facility constructed in accordance with the invention of the parent application.
Figure 17:
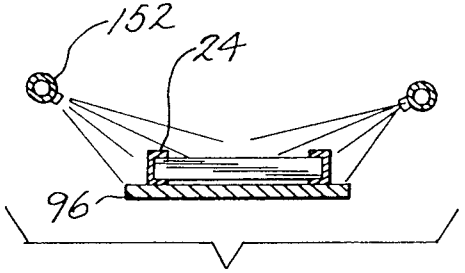
FIG. 17 is a sectional view taken along line 17—17 of FIG. 13.

FIG. 18 shows another embodiment, and uses like reference numerals from the above FIGS. where appropriate to facilitate clarity. A servicing station 180 is spaced along the periphery of hub 30. Building 182 has an opening 184 at station 180. The carousel pivot arm is movable to a lowered position at servicing station 180, passing through opening 184 in building 182 externally of the building to external servicing location 180 for servicing of the transport pivot arm. The arm is movable to an upward position at servicing station 180 remaining within building 182 and bypassing external servicing location 180 and instead passing within building 182 to the next station therein upon rotation of hub 30. Building 182 has an external recess 186 formed therein at servicing station 180 providing the external location for servicing of the pivot arm. Thus, when servicing is desired, the pivot arm is swung downwardly through opening 184 to permit servicing, and then pivoted back upwardly through opening 184 when the servicing is completed. This allows servicing of the pivot arm externally of the building, which is desirable because the servicing technican can remain outside the building and not have to work in the elevated temperatures within the building. When servicing is not desired, the pivot arm merely remains in its upward pivoted position at station 180 without passing through opening 184.

Figure 19:
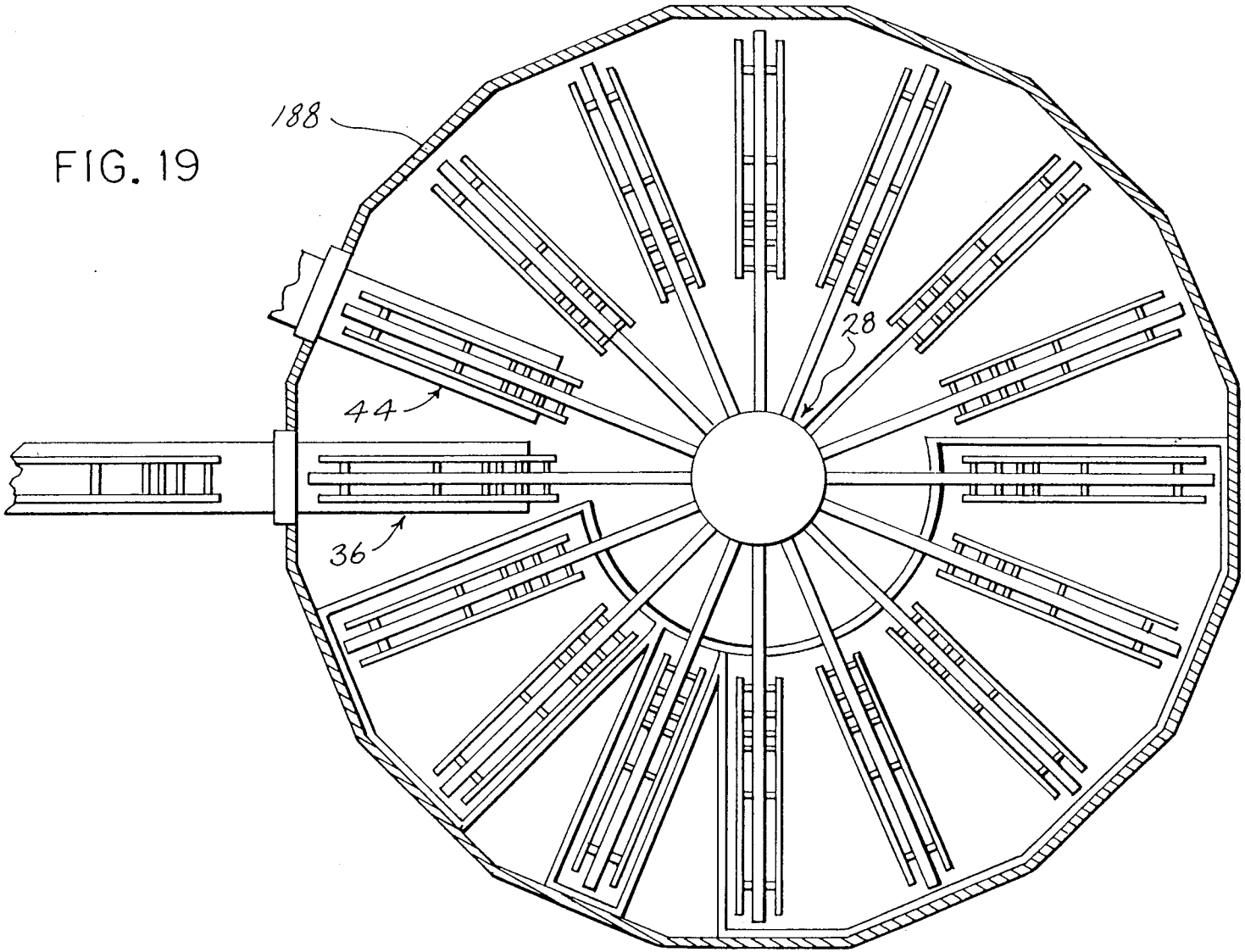
FIG. 19 is a top view of another embodiment of a manufacturing facility constructed in accordance with the invention of the parent application.

FIG. 19 shows another embodiment, and like reference numerals are used from the above FIGS. where appropriate to facilitate clarity. Building 188 has an increased number of stations which may provide various desired combinations of preheat washing, rinsing, coating, and dripping between loading station 36 and unloading station 44. The carousel at the core of the building is supported independently of the building, and may be moved to different locations and buildings as desired.

Numerous alternatives are possible. For example, instead of conveying the frames to the loading station with a conveyor, other conveyance mechanisms may be used, such as a cart, a shuttle, loading from beneath rather than through a sidewall opening, etc. While plural transport pivot arm assemblies are shown, single arm assemblies may of course be used. A facility with a single station in the building may also be used, to provide only coating within the building, and to provide loading and unloading externally of the building, as well as preheating if desired. The facilities and methods disclosed may also be used in cold coating processes. In further embodiments, the motor drive for the hub may be provided at the hub within the building, or may be provided externally of the building with an outer ring for mechanical advantage enabling a smaller motor and saving the motor from the harsh environment and elevated temperatures within the building. While a single frame per pivot arm of the carousel is shown, each arm may carry and dip more than one frame at a time. For example, one frame may be carried above the arm, and another frame below the arm. Further alternatively, multiple frames may be stacked, and carried by an arm.

Present Invention

FIGS. 20 and 21 show a manufacturing facility 200 with substantially reduced space requirements for applying a coating to vehicle structural components such as frame 202. A coating station is provided by a tank 204 containing coating liquid 206. A jib crane 208 is provided by a generally vertically extending hub 210 rotational about a generally vertical axis 212, a support beam 214 extending horizontally from hub 210, and a winch pulley 216 translatable on rollers 217 along beam 214 and having a cable 218 extending downwardly. Winch pulley 216 includes a motor (not shown) for lowering and raising cable 218. A carrier arm 220 is provided for carrying frame 202, comparable to above described arms 32, 34, etc. in the parent application, and is pivotally mounted to hub 210 below beam 214. Cable 218 is attached to arm 220 for moving the arm through the coating station. Arm 220 has depending hands such as 222 and 224, comparable to above described hands 72, 74, 76, 78, and fingers such as 226 and 228, comparable to above described fingers 80, 82, 84, 86, 88, 90, 92, 94, engaging frame 202.

Arm 220 pivots at mount 230 on hub 210 about a generally horizontal pivot axis 232 transverse to the direction of translation of pulley 216 along beam 214. As cable 218 is let out from winch pulley 216, arm 220 pivots downwardly about pivot axis 232, and pulley 216 translates rightwardly along beam 214 away from hub 210. The downward pivoting of arm 220 dips frame 202 into coating liquid 206 in tank 204. As cable 218 is retracted back up to pulley 216, arm 220 pivots upwardly about pivot axis 232, and pulley 216 translates leftwardly along beam 214 toward hub 210. The upward pivoting of arm 220 raises frame 202 out of coating liquid 206 in tank 204. It is preferred that pulley 216 be freely translatable on rollers 217 along beam 214. As arm 220 pivots downwardly and upwardly, it will cause right and left translation of the pulley along the beam, as cable 218 remains in a vertical position to support the weight of arm 220 and frame 202 as pulled downwardly by gravity. In another embodiment, the pulley can be further motorized to mechanically drive the pulley right and left along the beam. In a further embodiment, translation of the pulley along the beam can be limited, or the pulley can be located at a stationary position on the beam, and cable 218 will move through various angles relative to vertical as arm 220 pivots downwardly and upwardly.

A shell housing 234 is above and encloses tank 204. Housing 234 has a door 236 permitting entry and exit of arm 220 and frame 202. Housing 234 has a slot 238 through which cable 218 extends. The slot has a given configuration and extension permitting translation of cable 218 therealong as pulley 216 translates along beam 214. Slot 238 has a generally L-shaped configuration when viewed from above, FIG. 21. A first portion 240 of the slot extends toward and away from hub 210. A second portion 242 of the slot extends transversely to portion 240. Cable 218, arm 220 and frame 202 enter housing 234 in response to rotation of hub 210 about vertical axis 212. Cable 218, arm 220 and frame 202 enter housing 234 along a direction transverse to the direction of lowering and raising of frame 202 into and out of tank 204. Housing 234 has a top wall 244 in which slot 238 is formed, and has a sidewall 246 extending downwardly from the top wall. The sidewall has an opening 248 therein covered by door 236 mounted to the housing at hinges 250, 252 and 254. Arm 220 and frame 202 enter the housing through opening 248 in the housing sidewall. Arm 220 translates frame 202 horizontally during rotation of hub 210 to a position above tank 204. Arm 220 then lowers frame 202 into the tank to a generally horizontal position for coating of the frame. Arm 220 then raises the frame out of the tank, and hub 210 is rotated in the opposite direction such that arm 220 and frame 202 exit the housing through opening 248 in the sidewall. Movement of frame 202 in the coating station in housing 234 defines a travel path having a vertical height substantially less than twice the length of frame 202.

FIGS. 22 and 23 show a further embodiment and use like reference numerals from FIGS. 20 and 21 where appropriate to facilitate understanding. Tank 260 and housing 262 extend partially circumferentially around hub 210. Frame 202 is translated horizontally through tank 260, in a direction transverse to the longitudinal extent of the frame, in response to rotation of hub 210 about vertical axis 212. The slot in the top wall of the housing further includes an arcuate portion 264 along and above tank 260 and extending partially circumferentially around hub 210 and through which cable 218 extends when frame 202 is in its downwardly lowered position in tank 260. Cable 218 is translated along arcuate slot portion 264 as hub 210 rotates about vertical axis 212. External to the housing are a load station 266 and and unload station 268, for loading and unloading frames by a fork lift truck 270 or the like. FIGS. 23 shows an alternate door 272 for covering opening 274 in the sidewall of the housing. The door is not hinged as in FIG. 20, but instead slides along tracks 276 and 278 between a rightward open position as shown, and a leftward closed position.

FIGS. 24–26 show a further embodiment and use like reference numerals from above where appropriate to facilitate understanding. Housing 280 is extended all the way around hub 210 and encloses load and unload stations 266 and 268. Tank 282 only extends partially circumferentially around the hub. The frames enter and exit the housing on conveyors 284 and 286 as in the above noted parent application. The housing has a sidewall 288, FIG. 25, with an entrance opening 290 therethrough at loading station 266, and has hanging flexible leaves 292, as in the parent application, FIG. 11. Sidewall 288 of the housing has an exit opening 294, FIG. 26, therethrough with a quick acting guillotine door 296 actuated by pnuematic cylinder 298 to quickly move vertically upwardly and downwardly, as in the parent application, FIG. 12. The frames pass longitudinally through the entrance and exit openings in a generally horizontal position into and out of the housing. Openings 290 and 294 have minimum dimensions, to minimize heat loss from the housing. Also, multiple frames may be carried by an arm.

In other embodiments, the facility has different numbers of arms and/or tanks, including wash and rinse tanks as in the noted parent application.

It is recognized that various equivalents, alternatives and modifications are possible within the scope of the appended claims.

I claim:

1. A manufacturing method for applying a coating to vehicle structural components, comprising providing a coating station, providing a generally vertically extending hub and rotating said hub about a generally vertical axis, providing a support beam extending from said hub, providing a pulley on said beam and having a downwardly extending cable, providing a carrier arm for carrying a vehicle structural component and pivotally mounting said arm to said hub below said beam, attaching said cable to said arm and moving said arm through said coating station, and comprising pivoting said arm at said hub about a generally horizontal pivot axis, providing a tank containing coating liquid at said coating station, moving said cable downwardly to pivot said arm downwardly about said pivot axis to dip said vehicle structural component in a generally horizontal position into said coating liquid in said tank, and moving said cable upwardly to pivot said arm upwardly about said pivot axis to raise said vehicle structural component to a generally vertical position out of said coating liquid in said tank.

2. The invention according to claim 1 comprising providing a housing above and enclosing said tank, providing said housing with a door permitting entry and exit of said arm and said vehicle structural component, providing a slot in said housing through which said cable extends, translating said cable along said slot as said cable lowers and raises said vehicle structural component.

3. The invention according to claim 2 comprising providing said slot with a generally L-shaped configuration when viewed from above, translating said cable along a first portion of said slot toward and away from said hub, translating said cable along a second portion of said slot transversely to translation of said cable along said first portion, rotating said hub about said vertical axis to move said cable and said arm and said vehicle structural component into said housing along a direction transverse to the direction of lowering and raising of said vehicle structural component into and out of said tank.

4. The invention according to claim 3 comprising extending said tank partially circumferentially around said hub, rotating said hub about said vertical axis to translate said vehicle structural component through said tank, providing said slot with an arcuate portion along said tank extending partially circumferentially around said hub, rotating said hub to translate said cable along said arcuate portion of said slot with said vehicle structural component in its downwardly lowered position in said tank.

5. The invention according to claim 3 comprising providing said housing with a top wall and providing said slot in said top wall, providing said housing with a sidewall extending downwardly from said top wall, providing an opening in said sidewall covered by said door, moving said arm and said vehicle structural component into said housing through said opening in said sidewall.

* * * * *